United States Patent [19]

Datlow

[11] Patent Number: 4,944,417

[45] Date of Patent: Jul. 31, 1990

[54] SEPARATOR FOR STORED GARMENTS

[75] Inventor: David Datlow, Chevy Chase, Md.

[73] Assignee: J.D.'s, Washington, D.C.

[21] Appl. No.: 183,534

[22] Filed: Apr. 14, 1988

[51] Int. Cl.[5] ..... A47F 5/00

[52] U.S. Cl. ..... 211/184; 211/113; 223/87

[58] Field of Search ..... 211/184, 183, 113, 59.4, 211/43, 11, 118; 108/60, 61; 223/87; 24/457, 555, 563, 545

[56] References Cited

U.S. PATENT DOCUMENTS

| | | | |
|---|---|---|---|
| D. 158,530 | 5/1950 | Tobin . | |
| 164,461 | 6/1875 | Krelwitz | 24/563 |
| D. 283,468 | 4/1986 | Steinhilber . | |
| 1,483,058 | 2/1924 | Frank . | |
| 1,556,507 | 10/1925 | Gronauer . | |
| 1,675,286 | 6/1928 | Valkenburg | 24/563 X |
| 1,741,068 | 12/1929 | Newsom . | |
| 2,169,552 | 8/1939 | Bellin . | |
| 2,766,814 | 10/1956 | Sedlacek | 24/563 X |
| 3,424,314 | 1/1969 | Cornelsen | 211/123 X |
| 4,474,298 | 10/1984 | Bishop | 211/113 X |

FOREIGN PATENT DOCUMENTS

| | | | |
|---|---|---|---|
| 1035933 | 9/1953 | France | 211/113 |

*Primary Examiner*—Sarah A. Lechok

*Attorney, Agent, or Firm*—Lower, Price, LeBlance, Becker & Shur

[57] ABSTRACT

A garment separator suitable for use with expensive or fragile garments made of materials such as fur or silk includes a thin, flexible, smooth-sided, flat, integrally-formed separator element supportable from its top by an integral transverse extension which is readily locatable between adjacent garments supported on a common support rod by a clamping element that brackets the transverse extension of the separator element and grasps the support rod to prevent unintended relative movement therebetween.

15 Claims, 1 Drawing Sheet

Fig. 1
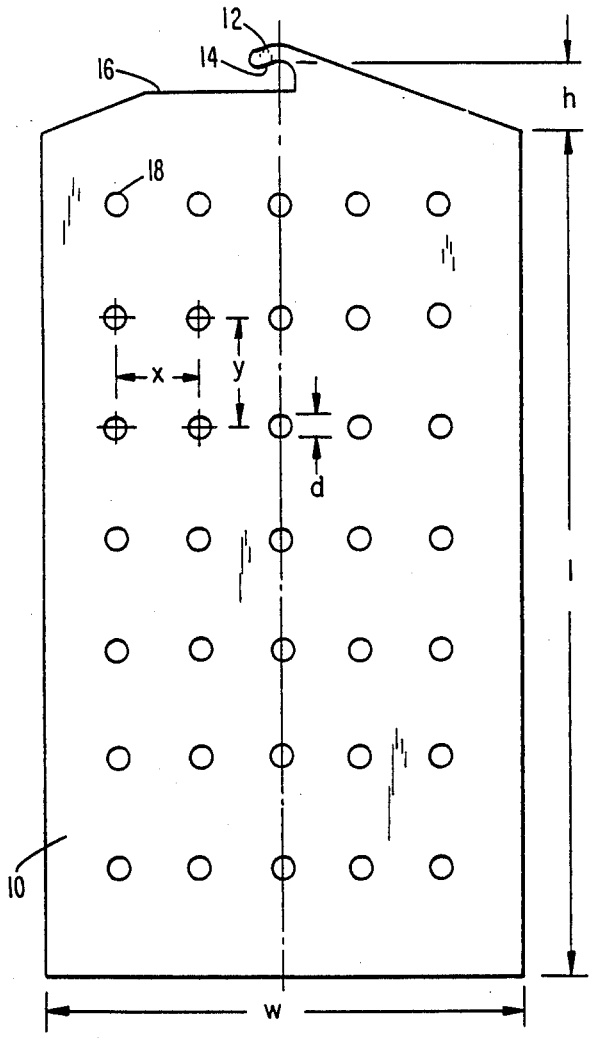
Fig. 2
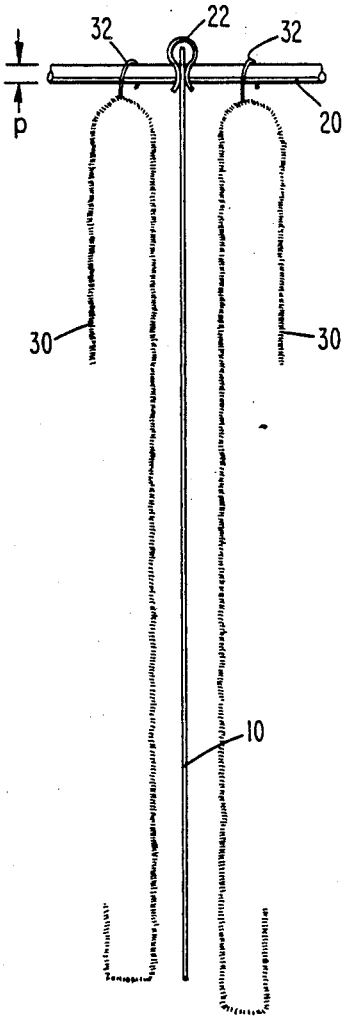
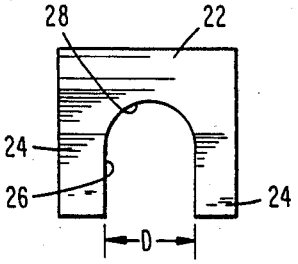
Fig. 3
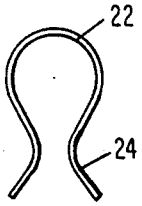
Fig. 4
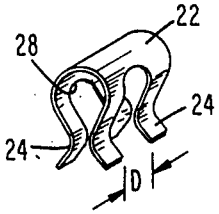
Fig. 5

SEPARATOR FOR STORED GARMENTS

FIELD OF THE INVENTION

This invention relates to garment separators and, more particularly, to separators readily placeable between adjacently stored garments which because of design or choice of material are relatively fragile or valuable.

BACKGROUND OF THE PRIOR ART

It is a well-known practice in the garment industry to store expensive and relatively fragile garments with particular care, often under carefully controlled ambient conditions. Thus, for example, expensive fur coats and the like which their owners may use only seasonally or occasionally are frequently stored in temperature and humidity controlled environments. Similar practices are applied to the storage of silk dresses and gowns. Even apart from such relatively large scale storage operations, individual users also may want to store their furs, silk or other valuable garments with care. Garments such as coats and dresses typically are suspended on appropriately sized and shaped hangers from horizontal rod-like supports and it is a preferred practice to employ separators between adjacently supported garments to minimize contact between them.

A variety of garment separators are known in the art. Thus, for example, U.S. Pat. No. 1,556,507 to Gronauer teaches a garment separator which is essentially a conventional wire-type metal clothes hanger to which is attached a sheet of paper or fabric of heavy texture so as to provide a flat surface that is disposable between adjacently supported garments. U.S. Pat. No. 1,483,058 to Frank discloses a very similar device in which two or more thicknesses of stiff cardboard are coupled by fabric binding strips around their edges so as to include at one end a wire hanger that is suspendable between adjacently suspended dresses on a common support rod to separate adjacent garments. U.S. Pat. No. 1,741,068 to Newsom teaches a somewhat more complex structure in which a plurality of flat, thin cedar slats are connected parallel to each other by a plurality of thin, flexible fabric strips, with the entire set suspended by hooks from a conventional wooden garment hanger.

Unfortunately, such known devices employ paper, cardboard or wood, all of which are materials that can absorb odor, moisture, oily dirt, and any sprayed-on chemicals that may be present on a particular garment and, by absorption at the outer surface of the separator, be transferable to other garments that may later contact the separator. Also, devices such as those of Gronauer and Frank, being of highly limited porosity, tend to inhibit cross-circulation of cooled and filtered air which is typically utilized to maintain a controlled environment around garments such as furs. Although the device of Newsom would permit circulation across the separator body, the cedar slats can absorb dirt and odor, e.g., the smells of cosmetics or cigarette smoke, and careless handling of the wooden slats could cause the formation of splinters which may snag on and damage materials such as fur and silk.

U.S. Design Pat. No. 283,468 to Steinhilber teaches a design showing a substantially rectangular, flat sheet-like element having a transverse extension at a top cut-away corner, the device being useable as a clothes separator when supported between adjacent garments. Naturally, this being a disclosure for a design, there is no teaching of suitable materials or discussion of details of the surfaces contactable by garments, nor is there any teaching of structure to facilitate cross-ventilation across the separator. Also, judging from the design illustrated in the figures it would appear that because of the generally unsymmetrical shape of the separator it would dispose a greater width of separator surface on one side of the support rod than on the other.

There exists, therefore, a need for a garment separator that is strong, flexible and safe to use with expensive or fragile garments, does not readily absorb dirt, odor, moisture or chemicals, is not bulky and is inexpensive to produce yet easy to store when not in use. The present invention discloses and claims such a garment separator.

SUMMARY OF THE DISCLOSURE

Accordingly, it is a principal object of this invention to provide a device for separating expensive or fragile garments adjacent each other without readily absorbing dirt, odors, moisture or chemicals from any garments contacted thereby.

It is another object of this invention to provide a relatively inexpensive, light, non-bulky and safe-to-use garment separator of a non-absorbent material that is particularly suitable for use with expensive or fragile garments.

It is a further object of this invention to provide a garment separator that has smooth outer surfaces and edges and is formed as a single integral piece of uniform composition.

It is an even further object of the present invention to provide a garment separator that is formed as a single integral element with smooth surface and edges of a non-absorbent material, that is formed to permit cross-ventilation with only minimal contact between adjacently supported garments separated thereby.

It is an even further object of this invention to provide a thin, flat, light, inexpensive garment separator of integral design formed only of fiberglass with smooth outer surfaces and edges, that is formed to be readily placeable between adjacently supported garments formed of expensive or fragile material.

It is a further related object of this invention to provide a combination of a light, flexible, inexpensive, smooth integrally formed garment separator element placeable between adjacent garments formed of expensive or fragile materials in cooperation with a readily applicable clamp element which insures that the garment separator element maintains its position on a common support rod that supports the separator element and adjacent garments, so that individual garments between thus utilized separator elements are allocated restrained positions with predetermined amounts of space therebetween for garments.

These and other related objects of the present invention are realized in a preferred embodiment by providing a flat separator element having a portion of a size and shape selected to extend substantially across the width and length of adjacently hung garments, the separator element being integrally formed at a first end to have a transverse extension supportable by a support rod so as to hold the separator element vertically below the support rod.

In another aspect of the invention, this separator element acts in combination with a restraining clamp means for clamping to said support rod while restraining sliding of the separator element along the support rod from a selected location thereon.

BRIEF DESCRIPTION OF THE DRAWINGS

FIG. 1 is a side elevation view of a separator element according to a preferred embodiment of this invention.

FIG. 2 is an elevation edge-on view of a separator element according to a preferred embodiment of this invention, placed on a common support rod with clamping means locating the separator element thereon between two adjacently supported garments.

FIG. 3 is a side elevation view of a clamp element of the combination according to a preferred embodiment of this invention.

FIG. 4 is an end elevation view of the clamp of FIG. 3.

FIG. 5 is a perspective view of a clamp element according to FIGS. 3 and 4.

DESCRIPTION OF THE PREFERRED EMBODIMENTS

As best understood with reference to FIG. 1, a separator element of this invention, in a preferred embodiment thereof, is a flat, sheet-like element 10 having a substantial portion preferably of a rectangular shape, of which the longest sides would be disposed vertically during use. Although it is not immediately clear from the figures, it is intended that the separator element have smooth surfaces on both sides and that the edges and corners all be formed to be smooth and free of sharp discontinuities that could snag or otherwise damage expensive or fragile garments. The top end of separator element 10 as visualized during normal use thereof may conveniently be provided with upwardly slanting edges leading toward a center-line with a small portion cut away from one side so as to leave a transverse extension 12 having an arcuate lower edge 14 above a horizontal edge 16 displaced from the transverse extension 12 by a distance sufficient to permit the entry therethrough of any support rod on which the separator element is to be supported.

While it will be appreciated by persons skilled in the art that the exact shape and size of such a separator element is a matter of choice and normally will be decided in light of the circumstances of its intended use, exemplary dimensions for use in separating fur coats in an air conditioned storage facility are as follows: width "w" approximately 24 inches; length "l", so as to extend from the top of an adjacent garment to below its lowest point, being approximately 50 inches; a height from the top of the support rod (the highest point in the arcuate edge 14 of transverse element 12) to the top of the vertical sides being approximately 4 to 5 inches; and aperture diameters "d" approximately 1 ¼ inches with the apertures being disposed in vertical columns x=4 inches apart and in horizontal rows y=6 inches apart.

The number, size and shape selected for apertures 18 must depend on the degree of cross-ventilation desired between adjacent garments but care must be taken to avoid excessive direct contact between neighboring garments across these apertures.

Although any suitable plastics material that can be cut, apertured and otherwise formed as hitherto described would be quite suitable for its intended purposes, a preferred material for forming such a separator element 10 is fiberglass. By its very nature, the resin commonly utilized in forming fiberglass sheets can be readily provided with a shiny, smooth surface and does not readily absorb or hold dirt, odors, moisture or chemicals. Fiberglass edges can be easily formed or sanded to be smooth and nonsnagging. Because of the distribution of glass fiber elements, generally in random directions within the sheet-like structure of the separator element, such an element will have sufficient inherent strength at the transverse extension 12 to support the weight of the separator element and to allow for any incidental loads proposed by a user in placing the separator element on a support rod. Finally, the fiberglass resin can be inherently colored in a variety of colors suitable for coding all the garments separated by such separator elements. Also, numbers or other helpful insignia can be readily provided within or on the fiberglass surface to facilitate location of garments, inventory control, processing schedules, or the like as appropriate in the given storage facility or application. Other suitable materials, albeit at different costs, include nylon and any of a large number of commercially available plastics materials.

It is important to appreciate that the separator element in the preferred embodiment of this invention is a single thin, flat, smooth-sided and edged, integrally formed sheet-like element that is designed to be readily placed on a support rod or removed therefrom and which can be stored in large numbers by simple stacking together with other similar separator elements. If fiberglass is used as the material for forming the separator element 10, a suitable thickness is approximately 0.005 inches. At this thickness, such a separator element is very light, flexible but firm, and takes up virtually no useful space between garments.

None of the known prior art garment separators provides the user any freedom to firmly locate the separator at a selected position on a support rod. As best understood with reference to FIG. 2, in the preferred embodiment of this invention the separator element 10 is typically suspended on a horizontal support rod 20 in combination with readily applied clamp 22 that brackets the transverse extension 12 of separator element 10 while firmly grasping support rod 20. Referring now to FIGS. 3, 4 and 5, it will be understood that a clamp 22 according to a preferred embodiment of this invention can conveniently be formed of a springy, flat metal sheet having an upper curved portion from which depend, preferably, four arms 24 disposed by pairs. The inner edges 26 of the pair of arms disposed on a given side of separator element 10 during use are separated by a distance "D" that is not greater than but preferably should be slightly less than a typical transverse dimension "P" of support rod 20. Thus, support rod 20 could be a cylindrical rod of circular section with a diameter "P", in which case the inner edges 26 of arms 24 of clamp 22 may be connected by an arcuate edge 28 of comparable diameter. On the other hand, if support rod 20 is selected to be of square cross-section, then its typical transverse dimension "P" would be the length of the square cross-section and the dimension "D" of clamp 22 should be not greater than but preferably slightly smaller than "P." So long as the support rod 20 is made of a strong, non-wearing material, e.g., metal tubing, the requirement that "D" be slightly smaller than "P" will ensure that downward pressure by a user on the upper curved surface of clamp 22 (so as to bracket the transverse extension 12 of separator element 10 on rod 20) will cause downwardly depending arms 24 to spread apart slightly until the clamp is firmly affixed to support rod 20. When this is done, accidental pushing and jostling of neighboring garments will not readily push separator element 10 away from its selected location because it would require a significant amount of force to generate sliding between edges 26 of clamp 22 and rod 20 clamped therebetween.

With the combination of separator element 10 and clamp 22, as described herein above, and as best understood with reference to FIG. 2, it becomes very convenient for a user to support a plurality of garments 30 on conventional hangers 32 suitable for the purpose and to insert separator elements 10 between adjacent garments and, after repositioning the garments and the separator to selected locations, to restrain separator element 10 in a selected position on support rod 20 by pressing a clamp 22 to bracket transverse extension 12 of the separator element 10.

Persons skilled in the mechanical arts will immediately appreciate that clamp 22 need not necessarily be formed with four downwardly depending arms 24, and that structures other than a single flat, springy steel member may be utilized in alternative forms for the structure of clamp 22. It will also be understood that although the combination of separator element 10 and clamp 22 provides certain distinct advantages over the use of separator element 10 alone, the use of a clamp 22 in combination with separator element 10 is a matter of user preference and not a necessity.

It is anticipated that persons skilled in the art, armed with the knowledge presented in this disclosure, will readily conceive of obvious modifications of the disclosed invention. Such modifications and related variations in the structure or manner of use of the present invention are regarded as comprehended within the claims appended hereinbelow. The present disclosure and drawings, therefore, should be regarded merely as descriptive and not as limiting of the scope of this invention.

I claim:

1. A device for separating garments hung adjacently on a common support rod comprising:

a flat separator element having a portion of a size and shape selected to extend substantially across the width and length of said hung garments, said flat separator element being integrally formed at a first end to have a transverse extension supportable by said support rod so as to hold said separator element vertically below said support rod; and a restraining clamp means mounted over said transversal extension for clamping to said support rod while restraining sliding of said separator element along said support rod from a selected location thereon, wherein said restraining clamp means is movable in infinitely variable increments along the longitudinal axis of said support rod.

2. The device according to claim 1, wherein: said flat separator element has smooth garment contacting surfaces and edges.

3. The device according to claim wherein: said flat separator element is formed to have a plurality of apertures for facilitating cross-flows of the ambient atmosphere therethrough.

4. The device according to claim 1, wherein: said transverse extension has an arcuate lower edge for contacting said support rod thereat.

5. The device according to claim wherein: said clamp means has a user-graspable portion and a plurality of rod-grasping extensions therefrom, at least one pair of said rod-grasping extensions being separated by a distance less than a characteristic transverse dimension of said support rod, whereby said clamp is restrained from unintentional sliding along said support rod.

6. The device according to claim wherein: said separator element is formed of a flexible plastic material.

7. The device according to claim 1, wherein: said separator comprises fiberglass.

8. The device according to claim 1, wherein: said clamp means comprises a springy material.

9. The device according to claim 5, wherein: said clamp means is formed to have two pairs of said rod-grasping extensions, one of each of said two pairs being disposable on said support rod on opposite sides of said transverse extension supporting said separator element on said support rod.

10. The device according to claim 6, wherein: said material is fiberglass.

11. The device according to claim 8, wherein: said springy material is steel.

12. A device for separating garments hung adjacently on a common support rod comprising:

a flat separator element having a portion of a size and shape selected to extend substantially across the width and length of said hung garments, said separator element being integrally formed at a first end to have a transverse extension supportable by said support rod so as to hold said separator element vertically below said support rod, said flat separator element having smooth garment contacting surfaces, edges and corners and a plurality of apertures, said transverse extension having an arcuate lower edge for contacting said support rod thereat, and said separator element being formed of a flexible plastic material; and restraining clamp means for clamping to said support rod while restraining sliding of said separator element along said support rod from a selected location thereon, said clamp means having a user-graspable portion and a plurality of rod-grasping extensions therefrom, at least one pair of said rod-grasping extensions being separated by a distance less than a characteristic transverse dimension of said support rod, whereby said clamp is restrained from unintentional sliding along said support rod, said clamp means being formed to have two pairs of said rod-grasping extensions, one of each of said two pairs being disposable on said support rod on opposite sides of said transverse extension supporting said separator element on said support rod, said clamp means comprising a springy material, wherein said restraining clamp means is movable in infinitely variable increments along the longitudinal axis of said support rod.

13. The device according to claim 12, wherein: the separator element has a thickness of approximately 0.005 inches.

14. The device according to claim 12, wherein: the plurality of apertures is disposed in a predetermined rectangular pattern.

15. The device according to claim 13, wherein: the apertures are approximately 1.25 inches in diameter.

* * * * *